US006769412B2

(12) United States Patent
Bayerle et al.

(10) Patent No.: US 6,769,412 B2
(45) Date of Patent: Aug. 3, 2004

(54) METHOD FOR INJECTING FUEL DURING THE START PHASE OF AN INTERNAL COMBUSTION ENGINE

(75) Inventors: Klaus Bayerle, Obertraubling (DE); Harry Schuele, Neunburg V. Wald (DE); Hong Zhang, Tegernheim (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/181,604

(22) PCT Filed: Nov. 15, 2001

(86) PCT No.: PCT/DE01/04285

§ 371 (c)(1),
(2), (4) Date: Jul. 16, 2002

(87) PCT Pub. No.: WO02/40848

PCT Pub. Date: May 23, 2002

(65) Prior Publication Data

US 2003/0000501 A1 Jan. 2, 2003

(51) Int. Cl.[7] ..... F02M 51/00; F02D 41/06
(52) U.S. Cl. ..... 123/491
(58) Field of Search ..... 123/491, 90.15, 123/90.16, 295, 299, 436, 481

(56) References Cited

U.S. PATENT DOCUMENTS

| | | | | | |
|---|---|---|---|---|---|
| 4,941,449 | A | | 7/1990 | Höptner et al. | 123/490 |
| 4,998,522 | A | | 3/1991 | Achleitner | 123/491 |
| 5,022,374 | A | * | 6/1991 | Denz et al. | 123/490 |
| 5,209,202 | A | * | 5/1993 | Maurer et al. | 123/406.18 |
| 5,269,274 | A | * | 12/1993 | Flaetgen et al. | 123/406.62 |
| 5,447,143 | A | * | 9/1995 | Ott et al. | 123/612 |
| 5,460,134 | A | * | 10/1995 | Ott et al. | 123/476 |
| 5,595,161 | A | * | 1/1997 | Ott et al. | 123/491 |
| 6,202,634 | B1 | * | 3/2001 | Siegl | 123/612 |
| 6,218,799 | B1 | * | 4/2001 | Hori | 318/446 |
| 6,286,365 | B1 | * | 9/2001 | Lang et al. | 73/116 |
| 6,578,550 | B1 | * | 6/2003 | Rupp et al. | 123/406.13 |
| 2002/0157641 | A1 | * | 10/2002 | Sakakibara | 123/406.47 |

FOREIGN PATENT DOCUMENTS

| | | | | |
|---|---|---|---|---|
| DE | 195 24 112 | | 2/1996 | F02D/41/06 |
| DE | 197 41 966 | | 4/1999 | F02D/41/06 |
| EP | 0 371 158 | | 6/1990 | F02D/41/06 |
| JP | 185387 | * | 7/1994 | F02D/41/06 |

* cited by examiner

*Primary Examiner*—Hai Huynh
(74) *Attorney, Agent, or Firm*—Cohen, Pontani, Lieberman & Pavane

(57) ABSTRACT

During the starting of an internal combustion engine with fuel injection, so-called preliminary injections (I) are dispensed according to a certain preliminary injection strategy in order to build up a wall film in the cylinders and simultaneously provide an ignitable mixture for the initial combustion. To avoid a situation where the preliminary charges during the starting phase are too rich or too lean, different quantities of fuel are chosen for the preliminary injections (I), depending on the charges to be expected in the relevant cylinders.

10 Claims, 2 Drawing Sheets

METHOD FOR INJECTING FUEL DURING THE START PHASE OF AN INTERNAL COMBUSTION ENGINE

PRIORITY CLAIM

This is a U.S. national stage of application No. PCT/DE01/04285, filed on Nov. 15, 2001. Priority is claimed on that application and on the following application: Country: Germany, Application No.: 100 56 863.7, filed: Nov. 16, 2000.

Method for injecting fuel during the starting phase of an internal combustion engine.

BACKGROUND OF THE INVENTION

1. Field of the Invention

The present invention relates to a method for injecting fuel into a multi-cylinder internal combustion engine.

2. Description of the Related Art

When starting an Otto engine in the case of a known method, each of the cylinders is supplied once with what is referred to as a preliminary injection in order to wet the cylinder walls and, at the same time, provide an ignitable mixture for the initial combustion. Since there is as yet no synchronization between the camshaft and the crankshaft and the position of the pistons is unknown at this point in time, a selective preliminary injection strategy is required in order to minimize the emission of unburnt fuel and hence pollutant emissions during starting.

In a method disclosed by EP 0 317 158 B1, to which U.S. Pat. No. 4,998,522 corresponds, the cylinders are divided into a first and a second group of cylinders, depending on the two different levels of the camshaft signal. The cylinders of the first group are supplied simultaneously with the preliminary injections (group injections) immediately after detection of starting, while there is a delay between the preliminary injections for the cylinders of the second group. At the same time, the quantities of fuel chosen for the preliminary injections are the same.

It has now been found that the air charges in the cylinders are not the same, even when starting, due to the gas dynamics in the intake pipe. Thus, owing to the stationary column of air in the intake pipe the first cylinders are not so well filled as the subsequent cylinders, where the air in the intake pipe has already reached a significant flow velocity and a corresponding kinetic energy. The result is that the fuel/air mixtures (lambda values) of the initial preliminary charges are richer than the subsequent preliminary charges. This leads to increased pollutant emissions in the starting phase, something that should be avoided, especially in the case of internal combustion engines that are optimized in terms of pollutants.

SUMMARY OF THE INVENTION

The object on which the present invention is based is to specify a method for injecting fuel into a multi-cylinder internal combustion engine, in which fuel/air mixtures with different lamba values are largely avoided in the starting phase.

According to the invention, different quantities of fuel for the preliminary injections are specified, depending on the sequence of preliminary injections and on the air charges to be expected in the cylinders.

The present invention is based on the realization that, after being switched off with the clutch disengaged, an internal combustion engine always stops at certain discrete positions, the number of discrete positions over two revolutions of the crankshaft (760°) corresponding to the number of cylinders. In the case of n cylinders, there are thus n angular stopping positions, which are moreover at the same angular distances apart. Furthermore, tests have shown that the rotational-speed behavior of the internal combustion engine and the time relationship between the opening of the inlet valves and rotational speed during the starting phases is always similar, irrespective of the discrete position in which the internal combustion engine has stopped. Essentially the same sequence of different air charges for sequential preliminary injections is thus obtained with each start.

This makes it possible to estimate the air charges to be expected for the sequential preliminary injections. The quantities of fuel for the preliminary injections can therefore be chosen appropriately as a function of the sequence of preliminary injections and the air charges to be expected, it being necessary to determine the air charges to be expected only once and it then being possible to use the corresponding values for each start. Since the air charges depend primarily on the rotational speed in the respective intake phase, the air charges are preferably determined as a function of the rotational speeds to be expected in the respective intake phases.

In a particularly advantageous refinement of the method according to the invention, the quantities of fuel for the preliminary injections are determined by multiplying a standard quantity by weighting factors, which are each assigned to one preliminary injection. If the weighting factors could also be estimated, they are expediently determined experimentally for each series of an internal combustion engine and then stored in the central control unit.

As mentioned, the present invention exploits the fact that the internal combustion engine always stops at certain discrete positions after being switched off with the clutch disengaged. However, it should be emphasized that it is not necessary to know this stopping position to carry out the method according to the invention. On the contrary, it is sufficient for the method according to the invention to know the sequence of the preliminary injections in order to specify the quantities of fuel for the preliminary injections as a function of these.

By means of the method according to the invention, it is ensured that, even in the starting phase, the preliminary injections are dispensed in quantities that are at least approximately adequate for the respective air charge. Excessively rich or excessively lean fuel/air mixtures are thus avoided, resulting in a corresponding reduction in pollutant emissions.

DETAILED DESCRIPTION OF THE PRESENTLY PREFERRED EMBODIMENTS

Figure 1:
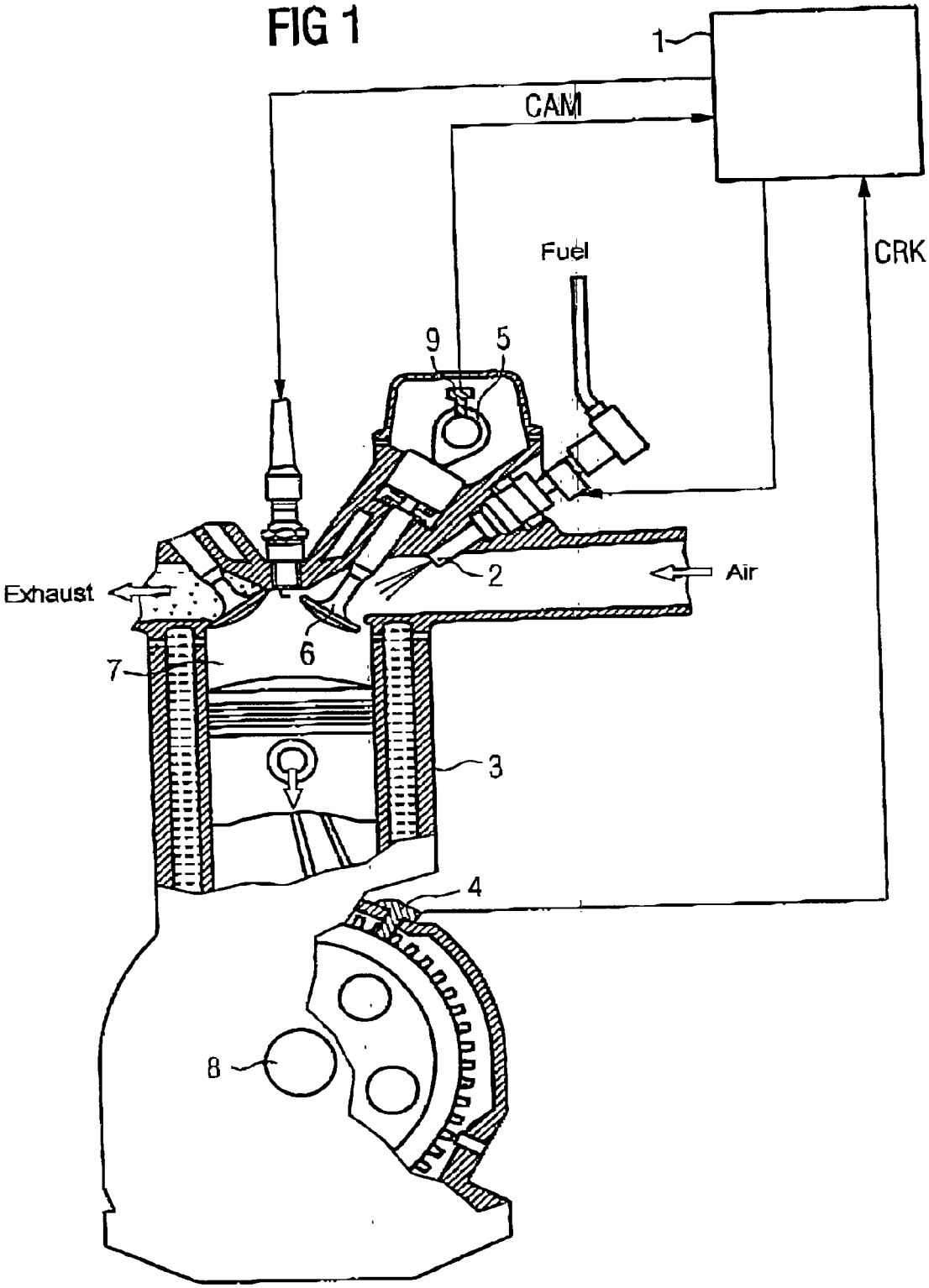
FIG. 1 is a partially sectioned elevation view of an internal combustion engine in the form of an Otto engine with petrol injection.

FIG. 1 shows a schematic partial section through an internal combustion engine, which is designed as a four-cylinder Otto engine with petrol injection in the exemplary embodiment described.

As is customary, the internal combustion engine 3 is assigned a central electronic control unit 1, which controls the ignition, fuel injection and other processes of the internal combustion engine. Each cylinder 7 is assigned at least one inlet valve 6 and at least one injection valve 2. The injection valve 2 sprays fuel into the intake pipe directly onto the valve disk of the inlet valve 6.

The crankshaft 8 is assigned a crankshaft sensor 4 with a toothed transmitter wheel that produces a crankshaft signal CRK (see lower half of FIG. 2) representing the crankshaft angle. The camshaft 5, which controls the inlet valves 6 and rotates at half the rotational speed of the crankshaft 8, is assigned a camshaft sensor 9 for producing a camshaft signal CAM. The camshaft 5 can be capable of angular adjustment relative to the crankshaft 8 although this is not required for the method to be described.

Figure 2:
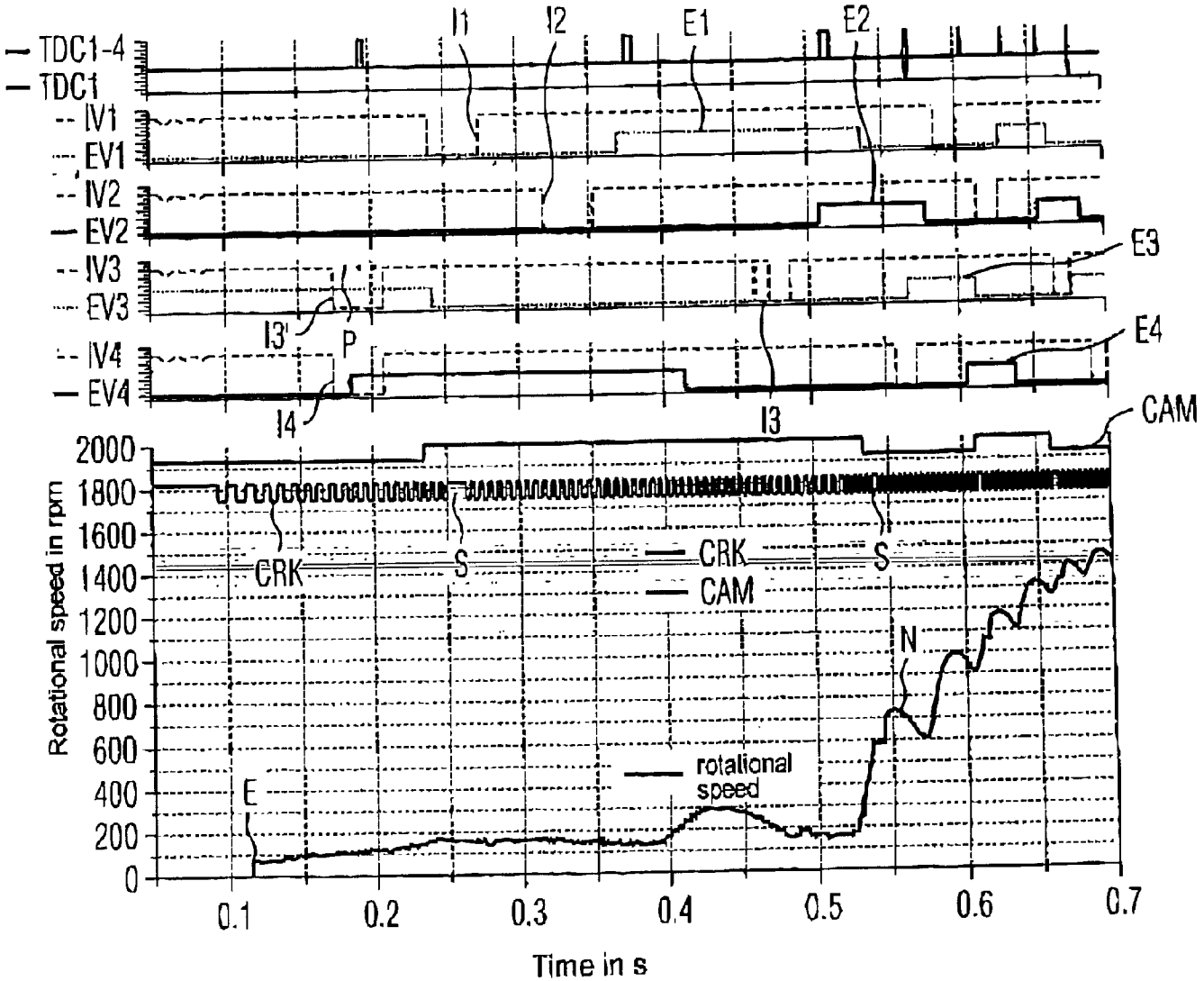
FIG. 2 shows a diagram in which rotational-speed, camshaft, crankshaft, injection-valve and inlet-valve signals are plotted against time.

In the lower half of FIG. 2, the crankshaft signal CRK, the camshaft signal CAM and the rotational speed N are each plotted against time. Each pulse of the crankshaft signal CRK corresponds to one tooth of the transmitter wheel, a double tooth gap after every 60 teeth serving as a synchronization pulse S for one full revolution of the crankshaft 8 in each case.

The camshaft signal CAM has two different levels, which are assigned to two successive revolutions of the crankshaft. The camshaft signal CAM and the crankshaft signal CRK with its synchronization pulses S allow an unambiguous relationship to be established for the position of the crankshaft within the operating cycle.

During normal operation of the internal combustion engine, the injection valves 2 can therefore be activated and actuated in the customary sequential injection mode with the aid of the crankshaft signal and the camshaft signal. During starting, however, the position of the crankshaft and hence the position of the pistons is not yet known and there may also be as yet no synchronization between the camshaft and the crankshaft. Injection in the sequential injection mode is therefore not possible.

Tests have shown that an internal combustion engine always stops at discrete positions after being switched off with the clutch disengaged. In the case of a four-cylinder internal combustion engine, these are exactly four positions over 760° of crankshaft rotation in each case. As regards the toothed transmitter wheel of the crankshaft sensor 4, this always results in positions of either 20 (±7) teeth or 50 (±7) teeth before a synchronization pulse S, for example. The angular interval between these positions is thus 180° (±42°). In the case of a six-cylinder internal combustion engine, 5 or 25 or 45 teeth before the next synchronization pulse S are obtained in a corresponding way as positions for the toothed transmitter wheel of the crankshaft sensor; the angular interval between the positions is then 120°. In general, the number of angular stopping positions at which an internal combustion engine stops corresponds to the number of cylinders. It has also been found that the angular stopping positions become increasingly discrete as the number of cylinders increases.

Furthermore, tests have shown that, when starting an internal combustion engine, the rotational-speed behavior is always the same or at least similar in relation to the actuation of the inlet valves, irrespective of the position from which the internal combustion engine was started. In other words, the rotational speed has a first value when the first inlet valve is opened, a second (higher) value when the second inlet valve is opened etc, these values remaining approximately the same for all starts given the same starting temperature and the same fuel grade. From that it follows that the air charges of the successively supplied cylinders also have corresponding values when starting, these values becoming larger in the order of their supply because of the increasing flow velocities in the intake pipe but being essentially the same for all starts.

This fact can be exploited, as already explained in the introduction to the description, to specify the quantities of fuel for the preliminary injections as a function of the sequence of preliminary injections set and the air charges to be expected in the relevant cylinders or of the rotational speed of the internal combustion engine.

In practice, the procedure is expediently such that the quantities of fuel for the preliminary injections are determined by multiplying a standard quantity by weighting factors. When determining the weighting factors, it is of course also necessary to take account of other operating characteristics of the internal combustion engine, especially satisfactory starting behavior. The weighting factors are therefore expediently determined by tests for the internal combustion engines of a series and stored as fixed values in the central control unit. If the maximum possible quantity of fuel for a preliminary injection is defined as the standard quantity, for example, the weighting factors are within a range of from 0.7 to 1.0, for example.

In principle, the method according to the invention can be used with any desired preliminary injection strategies, even with the method according to EP 0 371 158 B1, for example, which has already been discussed in the introduction, where the preliminary injections of a first group of cylinders are simultaneous and there is a delay between the preliminary injections of the second group of cylinders. However, the method according to the invention is used with particular success with a preliminary injection strategy in which all the preliminary injections occur one after the other according to a time sequence. An example of a preliminary injection strategy of this kind is explained in greater detail below with reference to FIG. 2.

In the lower half of FIG. 2, the rotational speed N of the internal combustion engine is plotted against time next to the crankshaft signal CRK and the camshaft signal CAM. In the upper half of FIG. 2, the activation signals IV1–IV4 for the four injection valves for the four cylinders 1 to 4 of the four-cylinder internal combustion engine are plotted against time, the four preliminary injections I being denoted by I1–I4. Moreover, the activation signals EV1–EV4 for the four inlet valves are plotted against time, the opening pulses for the opening of the inlet valves being denoted by E1–E4. Moreover, the pulses for the top dead center (TDC1–TDC4) of the four cylinders and the top dead center (TDC1) of cylinder 1 are shown in the two uppermost lines of FIG. 2.

As indicated in FIG. 2 in connection with the rotational speed, start detection E is provided for the starting of the internal combustion engine. At this point in time, the camshaft signal CAM is at either a high level or a low level, being at a low level in the example shown in FIG. 2. Cylinders 1 to 4 can thus be divided into two groups—as in the method described at the outset and disclosed in EP 0 371 158 B1 for example (into a first group comprising cylinders 3, 4 and a second group comprising cylinders 1, 2 in the example shown in FIG. 2). Moreover, this also shows whether the internal combustion engine has stopped in the first two angular stopping positions or the second two stopping positions. In other words, the number of unknown angular stopping positions is reduced to two.

In the previously known method according to EP 0 371 158 B1, the two cylinders 3, 4 of the first group of cylinders are supplied simultaneously with the preliminary injections at a specified angular interval with respect to start detection E (e.g. after eight detected and valid teeth of the crankshaft sensor), as indicated by preliminary injections I3' and I4. However, in this case preliminary injection I3' would be discharged just before the closure of the associated inlet valve EV3, which would lead to overenrichment of the fuel/air mixture and the emission of unburnt fuel.

According to the preferred preliminary injection strategy, only the cylinder whose inlet valve is definitely closed or predominantly closed is therefore supplied with the preliminary injection after start detection E; in the example in FIG. 2, this is cylinder 4, which is supplied with preliminary injection I4. Preliminary injection I3', on the other hand, is not discharged at this point in time, as indicated by a dotted line P.

As already mentioned, it is not yet known at the time when the first preliminary injection I4 is discharged whether the internal combustion engine has stopped at the first or the second angular stopping position (50 or 20 teeth before the first synchronization pulse S). In the example in FIG. 2, the crankshaft has stopped 20 teeth before the first synchronization pulse S. If, therefore, the first synchronization pulse S has already occurred after 28 teeth from start detection E (i.e. 20 teeth after the first preliminary injection I4) (this being the case in the example in FIG. 2), this shows that the crankshaft stopped 20 teeth before the synchronization pulse S. As soon as the synchronization pulse S has occurred, the internal combustion engine is synchronized, and a defined sequence of preliminary injections taking place after the synchronization pulse S can thus be determined by the central control unit 1.

As can be seen from FIG. 2, this preliminary injection strategy gives rise to a defined sequence of cylinders supplied successively with preliminary injections I, in the case illustrated cylinder 4, cylinder 1, cylinder 2 and cylinder 3. The quantities of fuel in the associated preliminary injections I4, I1, I2 and I3 are determined by multiplying the standard quantity by the fix specified weighting factors.

If the internal combustion engine has stopped at one of the other three possible angular stopping positions, the sequence of cylinders supplied with the preliminary injections does change. However, since the rotational-speed behavior during the starting phase always remains essentially the same in relation to the intake phases of the successively opening inlet valves, the quantities of fuel in the successive preliminary injections I can always be determined with the aid of the same weighting factors.

The preliminary injection method described above is only one example of a preliminary injection strategy in which the method according to the invention can be used. It should be emphasized in particular once again that it is not necessary to know the angular stopping positions of the internal combustion engine to carry out the method according to the invention.

What is claimed is:

1. A method for injecting fuel into a multi-cylinder internal combustion engine with at least one injection valve (2) per cylinder (7), with a camshaft (5) for actuating the inlet valves (6), which rotates at half the rotational speed of the crankshaft (8), with a crankshaft sensor (4), which supplies one crankshaft signal (CRK) representing the crankshaft angle with a synchronization pulse (S) for leach revolution of the crankshaft, and with a central control unit (1), which controls the injection valves (2) in such a way that they each inject one preliminary fuel injection (I) per cylinder (7) in a defined sequence during a starting phase and then inject quantities of fuel determined by the control unit (1) in normal sequential injection mode, wherein different quantities of fuel for the preliminary injections (I) are specified, depending on the sequence of preliminary injections (I) and on the air charges to be expected in the relevant cylinders (7).

2. The method as claimed in claim 1, wherein the air charges are determined as a function of the rotational speeds (N) to be expected of the internal combustion engine (3) during the respective intake phases of the relevant cylinders (7).

3. The method as claimed in claim 1, characterized in wherein the quantities of fuel for the preliminary injections (I) are determined by multiplying a standard quantity by specified weighting factors, which are each assigned to one preliminary injection (I).

4. The method as claimed in claim 3, wherein the weighting factors are determined experimentally for each series of internal combustion engines.

5. The method as claimed in claim 3, wherein the weighting factors become increasingly large from the first to the last preliminary injection or injections (I) in the sequence.

6. A method for injecting fuel into an internal combustion engine having a crankshaft, a plurality of cylinders, at least one fuel injection valve per cylinder, a control unit for controlling the injection valves, an inlet valve for each cylinder, and a camshaft for actuating the inlet valves, said camshaft rotating at half the rotational speed of the crankshaft, said method comprising sensing the crankshaft position by providing a synchronization pulse for each revolution of the crankshaft, injecting one preliminary fuel injection per cylinder in a defined sequence during a starting phase, each preliminary injection including a quantity of fuel which is determined by the control unit in dependence on the sequence of the injections and an expected air charge in the respective cylinder, and following said starting phase, in a normal sequential injection mode, injecting fuel into each said cylinder in a quantity determined by the control unit in dependence on the crankshaft position.

7. A method as in claim 6 comprising determining the expected rotational speed of the crankshaft during opening of the intake valves, and determining the air charges to be expected in each cylinder in dependence on the rotational speeds to be expected during opening of the respective intake valves.

8. A method as in claim 6 comprising assigning a weighting factor for each preliminary injection, and determining the quantity of fuel for each preliminary injection by multiplying a standard quantity by the respective weighting factor.

9. A method as in claim 8 comprising determining said weighting factors experimentally for each type of internal combustion engine.

10. A method as in claim 8 wherein said weighting factors increase progressively for each preliminary injection in the sequence.

* * * * *

UNITED STATES PATENT AND TRADEMARK OFFICE

CERTIFICATE OF CORRECTION

PATENT NO. : 6,769,412 B2
DATED : August 3, 2004
INVENTOR(S) : Klaus Bayerle et al.

It is certified that error appears in the above-identified patent and that said Letters Patent is hereby corrected as shown below:

Title page,
Item [30], Foreign Priority Data, please add the following:
-- (30) Foreign Application Priority Data
Nov. 16, 2000 (DE)……...100 56 863.7 --

Signed and Sealed this

Eleventh Day of January, 2005

JON W. DUDAS
*Director of the United States Patent and Trademark Office*